US006200156B1

(12) United States Patent
Hiraki et al.

(10) Patent No.: US 6,200,156 B1
(45) Date of Patent: Mar. 13, 2001

(54) TERMINAL FITMENT FOR LEAD WIRE CONNECTION AND HIGH-VOLTAGE VARIABLE RESISTOR UNIT WITH RELAY TERMINAL FITMENT

(75) Inventors: Kenichi Hiraki; Tsuyoshi Ohta; Kazufumi Daimon, all of Owawano-machi (JP)

(73) Assignee: Hokuriku Electric Industry Co., Ltd., Toyama Pref. (JP)

( * ) Notice: Subject to any disclaimer, the term of this patent is extended or adjusted under 35 U.S.C. 154(b) by 0 days.

(21) Appl. No.: 09/449,788

(22) Filed: Nov. 26, 1999

(30) Foreign Application Priority Data

Nov. 27, 1998 (JP) ..... 10-337010
Dec. 2, 1998 (JP) ..... 10-343014

(51) Int. Cl.[7] ..... H01R 11/20

(52) U.S. Cl. ..... 439/395; 338/162; 338/163; 338/160

(58) Field of Search ..... 439/395, 396, 439/397, 393, 391; 338/118, 128, 184, 190, 192, 193, 160, 161, 162

(56) References Cited

U.S. PATENT DOCUMENTS 5,358,423 * 10/1994 Burkhard et al. ..... 439/402
5,368,501 * 11/1994 Asbell ..... 439/418
5,475,358 12/1995 Kotani et al. .
5,517,171 5/1996 Kotani et al. .
5,746,610 * 5/1998 Shiu ..... 439/98
5,929,745 * 8/1999 Tsunezawa et al. ..... 338/160

* cited by examiner

*Primary Examiner*—Lincoln Donovan
*Assistant Examiner*—Kyung S. Lee
(74) *Attorney, Agent, or Firm*—Rankin, Hill, Porter & Clark LLP

(57) ABSTRACT

A lead wire connection terminal fitment capable of permitting a plurality of lead wires to be readily press-fitted in a single lead wire press fit groove. The terminal fitment may be in the form of a relay terminal fitment, which includes a metal plate formed with a lead wire press fit groove by machining in which lead wires are press-fitted. A pair of inner surfaces of the metal plate defining the lead wire press fit groove therebetween are formed thereon with a plurality of projections and recesses engaged with an outer periphery of lead wires. The projections biting into the lead wires are so arranged that a space defined between the projections opposite to each other is reduced in width at a position thereof spaced by a distance in a depth direction of the lead wire press fit groove, resulting in being divided into a first space portion increased in width and a second space portion decreased in width.

12 Claims, 8 Drawing Sheets

TERMINAL FITMENT FOR LEAD WIRE CONNECTION AND HIGH-VOLTAGE VARIABLE RESISTOR UNIT WITH RELAY TERMINAL FITMENT

BACKGROUND OF THE INVENTION

This invention relates to a lead wire connection terminal fitment and a high-voltage variable resistor unit with a relay terminal fitment, and more particularly to a high-voltage variable resistor unit such as a focus pack, a double focus or the like suitable for use for adjusting a focus voltage of a CRT and a soldering-less lead wire connection terminal fitment used for such a high-voltage variable resistor unit.

There has been conventionally known a soldering-less lead wire connection terminal fitment which is formed by subjecting a metal plate to machining and in which a lead wire is press-fitted, as disclosed in U.S. Pat. Nos. 5,475,358 and 5,517,171. A soldering-less lead wire connection terminal fitment disclosed in each of the U.S. patents is so constructed that a pair of inner surfaces which are arranged so as to surround or define a lead wire press fit groove and between which a lead wire is press-fitted are formed thereon with a plurality of indentations adapted to bite into an outer periphery of the lead wire, resulting in ensuring reliable mounting of the lead wire in the lead wire connection terminal.

Press fitting of a plurality of lead wires in the single lead wire press fit groove of the lead wire connection terminal fitment constructed as described above is carried out by deviating the lead wires from each other in a vertical direction. However, when press fitting of a plurality of lead wires different in diameter in the single lead wire press fit groove is to be carried out, determination of a width of the press fit groove on the basis of any specific one of the lead wires causes press fitting of lead wires larger in diameter than the specific lead wire in the groove to be hard. Also, it fails to permit the indentations to satisfactorily bite into lead wires larger in diameter than the specific one. In addition, when a plurality of lead wires having the same diameter are to be press-fitted in the groove, lead wires firstly fitted in the groove are increased in contact with the indentations of the groove, to thereby be excessively shaved or damaged by the indentations, resulting in being apt to be broken or cut.

SUMMARY OF THE INVENTION

The present invention has been made in view of the foregoing disadvantage of the prior art.

Accordingly, it is an object of the present invention to provide a lead wire connection terminal fitment which is capable of facilitating press fitting of lead wires in a lead wire press fit groove of the terminal fitment.

It is another object of the present invention to provide a high-voltage variable resistor unit equipped with a lead wire connection terminal fitment which is capable of facilitating press fitting of lead wires in a lead wire press fit groove of the terminal fitment.

It is a further object of the present invention to provide a high-voltage variable resistor unit equipped with a lead wire terminal fitment which is capable of permitting lead wires different in diameter to be readily and reliably press-fitted therein.

It is still another object of the present invention to provide a high-voltage variable resistor unit which is capable of facilitating connection between a relay terminal fitment and lead wires.

In accordance with the present invention, a lead wire connection terminal fitment is provided. The lead wire connection terminal fitment includes a metal plate formed with a lead wire press fit groove by machining in which lead wires are press-fitted. The lead wire press fit groove includes a lead wire insertion port and is arranged so as be open on both sides of the metal plate in a thickness direction thereof and extend in a direction away from the lead wire insertion port. The metal plate has a pair of inner surfaces defining the lead wire press fit groove therebetween. The inner surfaces of the metal plate are formed thereon with a plurality of projections and recesses engaged with an outer periphery of the lead wires. The projections are arranged so as to form a plurality of pairs in such a manner that each pair of projections are opposite to each other. The projections are arranged so that a space defined between the projections opposite to each other is stepwise reduced in width as a distance of the lead wire press fit groove from the lead wire insertion hole is increased.

Press fitting of a plurality of lead wires different in diameter in the lead wire press fit groove is carried out by firstly press-fitting lead wires reduced in diameter in the lead wire press fit groove and then press-fitting lead wires increased in diameter therein. This permits lead wires reduced in diameter to be arranged in a portion of the space of the lead wire press fit groove which is reduced in width and lead wires of an increased diameter to be arranged in a portion thereof which is increased in width. Thus, the present invention permit the lead wires different in diameter to be readily press-fitted in the lead wire fit groove.

Also, the above-described formation of the space in the lead wire fit groove permits press fitting of a plurality of lead wires having the same diameter in the groove to be carried out while preventing an outer periphery of lead wires firstly fitted therein from being damaged by the projections positioned near the lead wire insertion port, resulting in keeping the lead wires from being cut or broken.

The lead wire connection terminal fitment of the present invention may be used for a variety of electric equipments and electric components. For example, it may be used as a relay terminal fitment for a high-voltage variable resistor unit. A high-voltage variable resistor unit equipped with such a relay terminal fitment includes a casing made of an insulating resin material. The casing is formed on one side thereof with an opening and has a variable resistance circuit board receiving chamber, a fixed resistance board receiving chamber and a capacitor receiving chamber defined therein. The unit also includes a variable resistance circuit board received in the variable resistance circuit board receiving chamber while keeping a rear surface thereof facing the opening and provided on a front surface thereof with a variable resistance circuit pattern including an input electrode, a ground electrode and at least one output electrode. The unit further includes an input terminal fitment arranged on a rear surface of the variable resistance circuit board and electrically connected to the input electrode, a fixed resistance circuit board received in the fixed resistance circuit board receiving chamber and formed on a front surface thereof with a fixed resistance circuit pattern including first and second connection electrodes to which first and second fixed resistance circuit board lead wires are respectively connected, a relay terminal fitment arranged in any one of the fixed resistance circuit board receiving chamber and capacitor receiving chamber or in a boundary region between the fixed resistance circuit board receiving chamber and the capacitor receiving chamber and including a connection terminal section extending toward the opening of the casing and a lead wire connection section to which the lead wires are connected, and a capacitor including first and second capacitor lead wires and received in the capacitor receiving chamber. The first fixed resistance circuit board lead wire and second fixed resistance circuit board lead wire of the fixed resistance circuit board are connected to the input terminal fitment and the lead wire connection section of the relay terminal fitment, respectively. The first capacitor lead wire and second capacitor lead wire of the capacitor are connected to the lead wire connection section of the relay terminal fitment and a terminal fitment fixed in the casing. The relay terminal fitment is made by subjecting a metal plate to machining. The lead wire connection section is formed with a lead wire press fit groove in which the second fixed resistance circuit board lead wire and first capacitor lead wire are press-fitted. The lead wire press fit groove includes a lead wire insertion port open toward the opening of the casing and is arranged so as be open on both sides of the metal plate in a thickness direction thereof and extend in a direction from the lead wire insertion port toward a wall of the metal plate opposite to the opening. The metal plate has a pair of inner surfaces defining the lead wire press fit groove therebetween. The inner surfaces of the metal plate are formed thereon with a plurality of projections and recesses engaged with an outer periphery of the lead wires. The projections are arranged so as to form a plurality of pairs in such a manner that each pair of projections are opposite to each other. The projections are arranged so that a space defined between the projections opposite to each other in stepwise reduced in width as a distance of the lead wire press fit groove from the lead wire insertion hole is increased.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1A:
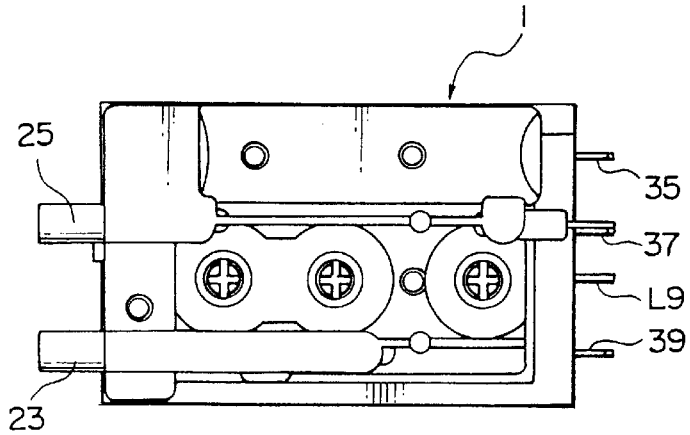
FIG. 1A is a plan view showing an embodiment of a high-voltage variable resistor unit according to the present invention.

Now, the present invention will be described hereinafter with reference to the accompanying drawings.

Referring first to FIGS. 1A to 1D, an embodiment of a high-voltage variable resistor unit according to the present invention is illustrated. A high-voltage variable resistor unit of the illustrated embodiment is adapted to be used for adjusting a focus voltage of a CRT, resulting in being commonly referred to as a focus pack or a double focus and includes an insulating casing 1. The high-voltage variable resistor unit of the illustrated embodiment is mounted in a transformer casing of a fly-back transformer so as to close an opening of the transformer casing through which the variable resistor unit is mounted in the transformer casing. After mounting of the high-voltage variable resistor unit in the transformer casing, an insulating resin material for transformer molding is filled in the transformer casing and an opening formed on a rear surface of the high-voltage variable resistor unit through a resin filling opening of the transformer casing. Thus, the insulating casing 1 of the high-voltage variable resistor unit is formed into a hollow shape while being formed on one side thereof with an opening, resulting in being a one-side open type. In the illustrated embodiment, the opening is formed on a rear side of the casing 1. The insulating casing 1 has an interior divided into a variable resistance circuit board receiving chamber 5, a fixed resistance circuit board receiving chamber 7 and a capacitor receiving chamber 9 through a partition wall 3. The fixed resistance circuit board receiving chamber 7 and capacitor receiving chamber 9 are arranged in a manner to be contiguous to each other along two side walls 3*a* and 3*b* of the variable resistance circuit board receiving chamber 5 adjacent to each other while cooperating with each other to form a substantially L-shape as viewed from a side of the opening of the insulating casing 1.

Figure 1C:
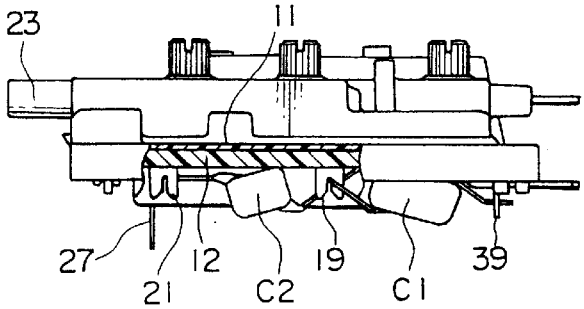
FIG. 1C is a partly broken side elevation view of the high-voltage variable resistor unit shown in FIG. 1A.
Figure 1D:
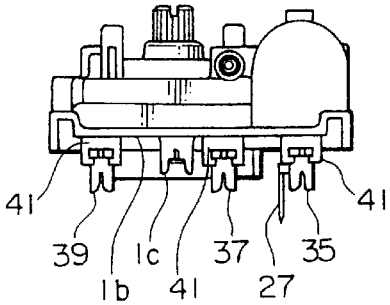
FIG. 1D is a front elevation view of the high-voltage variable resistor unit shown in FIG. 1A.
Figure 2A:
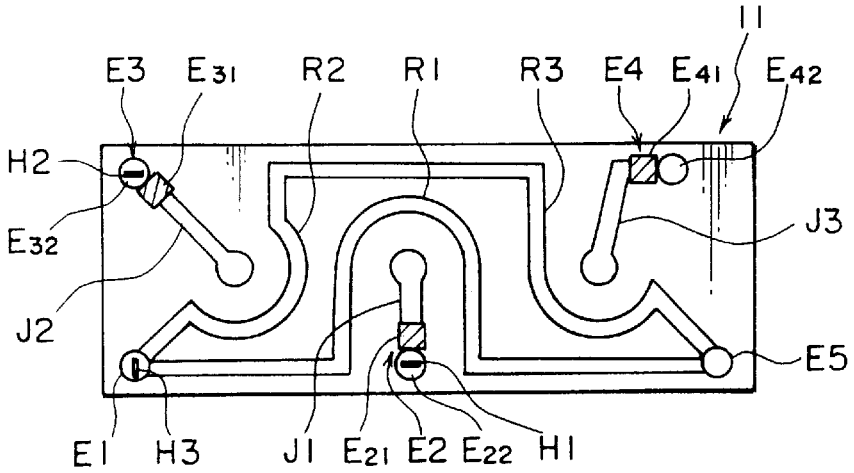
FIG. 2A is a schematic plan view showing a variable resistance circuit board used in the high-voltage variable resistor unit shown in FIGS. 1A to 1D.
Figure 2B:
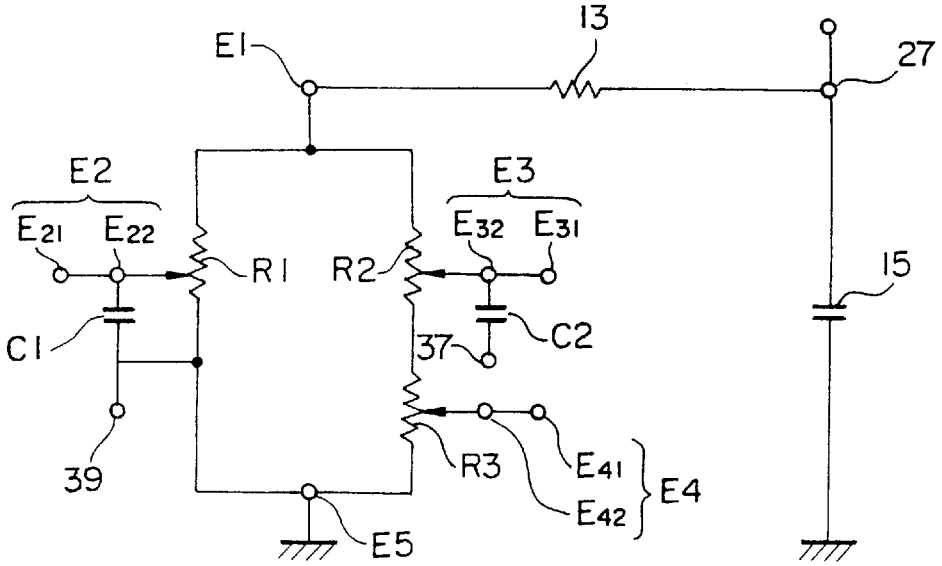
FIG. 2B is a circuit diagram of the high-voltage variable resistor unit shown in FIGS. 1A to 1D.

The variable resistance circuit board receiving chamber 5 has such a variable resistance circuit board 11 as schematically shown in FIG. 2A received therein while keeping a rear surface of the board 11 facing the opening of the insulating casing 1. The variable resistance circuit board 11 is provided on the rear surface thereof with an insulating resin layer 12 (FIG. 1C), which is formed by depositing insulating resin on the rear surface. The fixed resistance circuit board receiving chamber 7 has a fixed resistance circuit board 13 received therein, which constitutes a bleeder resistance. The fixed resistance circuit board 13 is formed on a front surface thereof with a fixed resistance circuit pattern including first and second connection electrodes and provided on both ends thereof with first and second fixed resistance circuit board lead wires L1 and L2 respectively connected to the first and second connection electrodes. The capacitor receiving chamber 9 has a capacitor 15 received therein. The capacitor 15 has a first capacitor lead wire L3 and a second capacitor lead wire L4 provided on any two ends thereof opposite to each other or both ends thereof. The members described above cooperate with each other to constitute a circuit shown in FIG. 2B.

The variable resistance circuit board 11 is made of a ceramic material and formed on a front surface thereof with an electrode pattern and a variable resistance circuit pattern. As shown in FIG. 2A, the electrode pattern includes an input electrode E1, first and second output electrodes E2 and E3 for outputting a focus voltage, a third output electrode E4 for outputting a screen voltage, and a ground electrode E5. The variable resistance circuit pattern includes focus voltage adjusting resistance elements R1 and R2, a screen voltage adjusting resistance element R3, other resistance elements, and current collecting patterns J1 to J3. Between the circuit board 11 and a upper wall of the insulating casing 1 are arranged focus and screen rotors each having a contact contacted with the variable resistance circuit pattern. The electrode pattern is formed of a silver paint or the like by printing and the variable resistance circuit pattern is formed by printing of a resistive paint. The output electrodes E2 and E3 include rectangular contact sections E21 and E31 each contacted with a contact terminal section of an output terminal member and circular soldering sections E22 and E32 each connected to a terminal fitment described hereinafter by soldering, respectively. The output electrode E4 likewise includes a rectangular contact section E41 contacted with the contact terminal section of the output terminal member and a circular section E42. The output electrodes E2 and E3 are connected to output conductors which are inserted through cylindrical sections 23 and 25 of the insulating casing 1 in such a manner known in the art as disclosed in Japanese Patent Application Laid-Open Publication No. 186006/1997, respectively. The soldering sections E22 and E32 are formed at a central portion thereof with slit-like through-holes H1 and H2 through which soldering sections of terminal fitments 19 and 21 described hereinafter are inserted, respectively. The input electrode E1 is likewise formed at a central portion thereof with a slit-like through-hole via which a soldering section of a terminal fitment 17 is inserted. In the illustrated embodiment, during formation of the variable resistance circuit pattern, a resistive paint is superposedly deposited on the contact sections E21, E31 and E41 of the output electrodes E2, E3 and E4 so as to be contiguous to the current collecting patterns J1 to J3 of the variable resistance circuit pattern by printing, resulting in providing a resistive paint layer which covers each of the contact sections E21, E31 and E41.

Figure 1B:
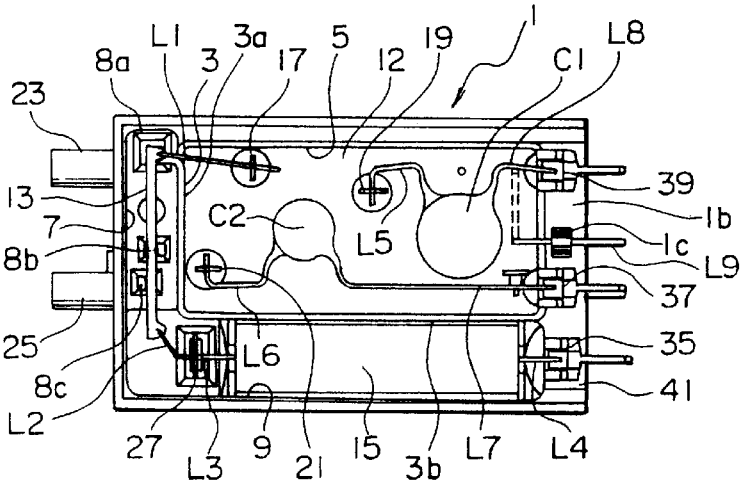
FIG. 1B is a bottom view of the high-voltage variable resistor unit shown in FIG. 1A.
Figure 3A:
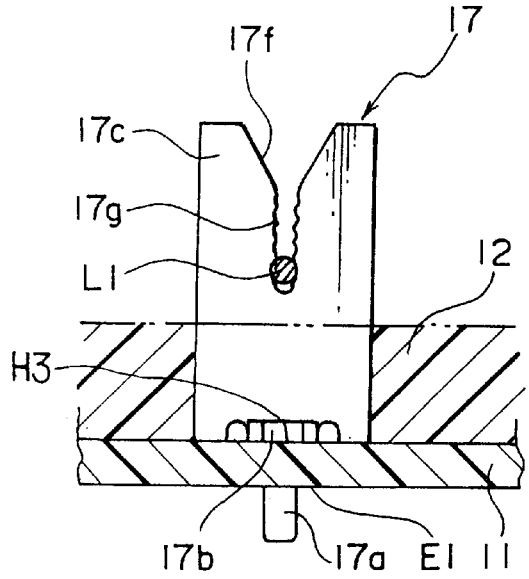
FIGS. 3A and 3B each are a fragmentary schematic sectional view showing a terminal fitment embedded in an insulating resin layer.
Figure 3B:
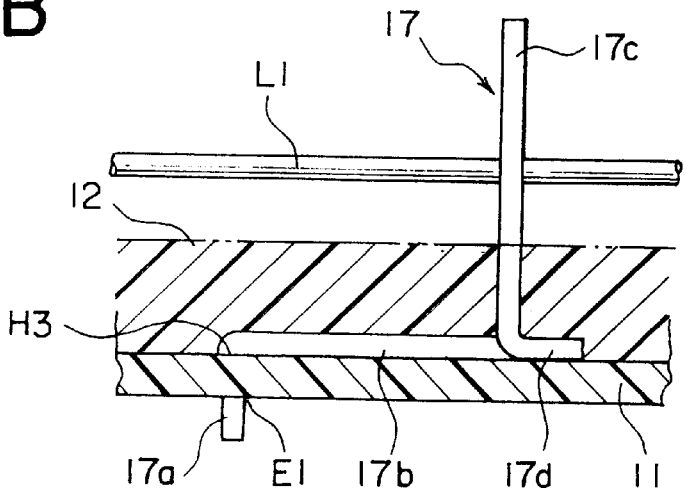
Figure 3C:
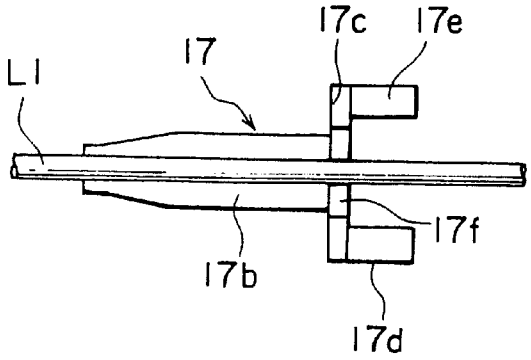
FIG. 3C is a plan view of the terminal fitment shown in FIGS. 3A and 3B prior to embedding thereof in the insulating resin layer.
Figure 4A:
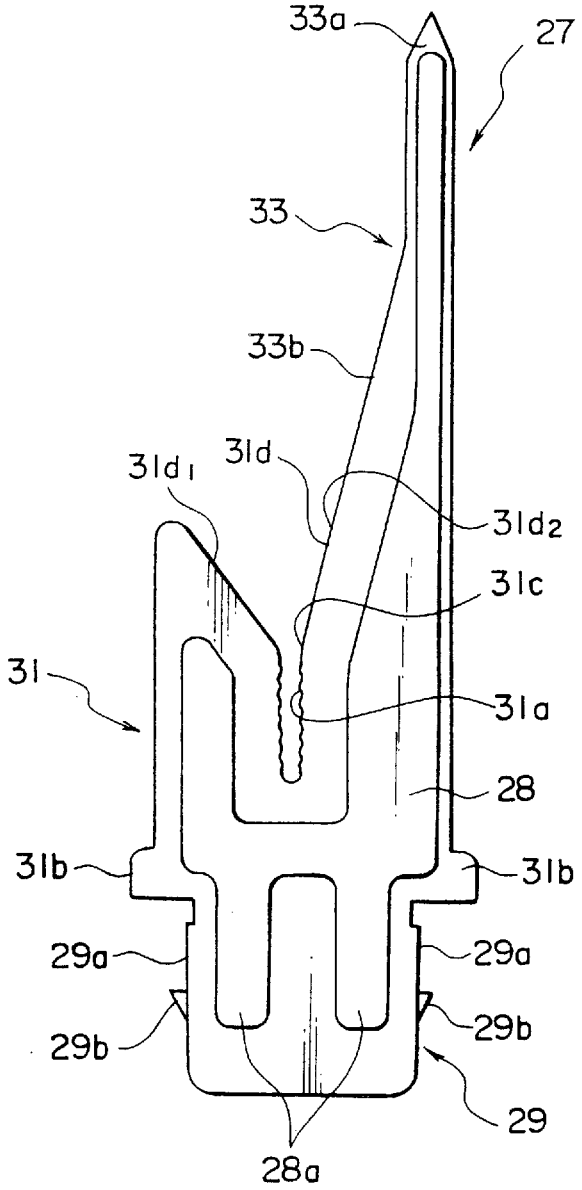
FIG. 4A is a plan view showing a relay terminal fitment incorporated in the high-voltage variable resistor unit shown in FIGS. 1A to 1D.
Figure 4B:
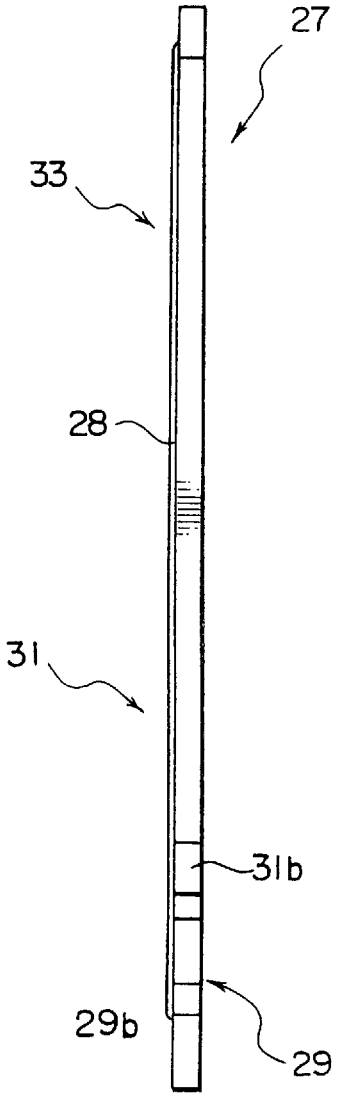
FIG. 4B is a side elevation view of the relay terminal fitment shown in FIG. 4A.
Figure 5A:
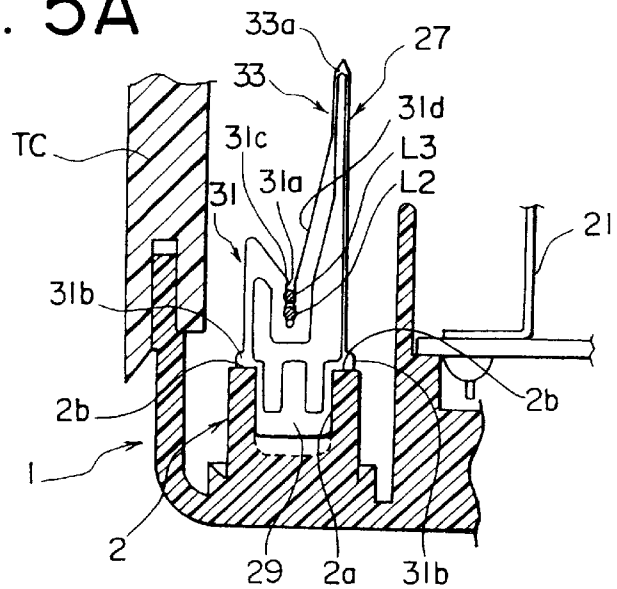
FIGS. 5A to 5C each are a sectional view showing mounting of a relay terminal fitment while keeping a transformer casing of a fly-back transformer combined with an insulating casing.
Figure 5C:
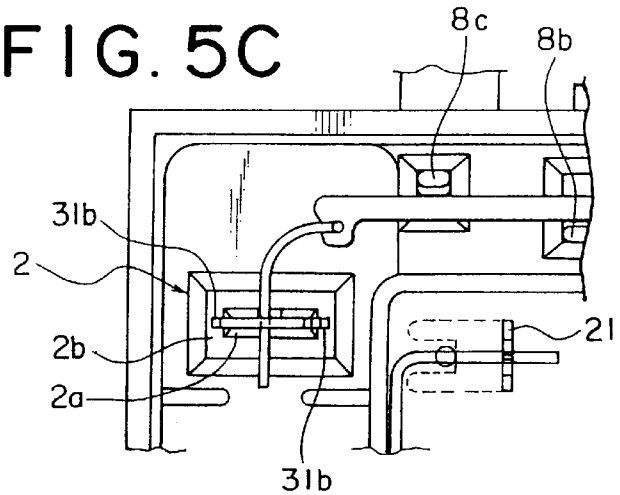
Figure 5B:
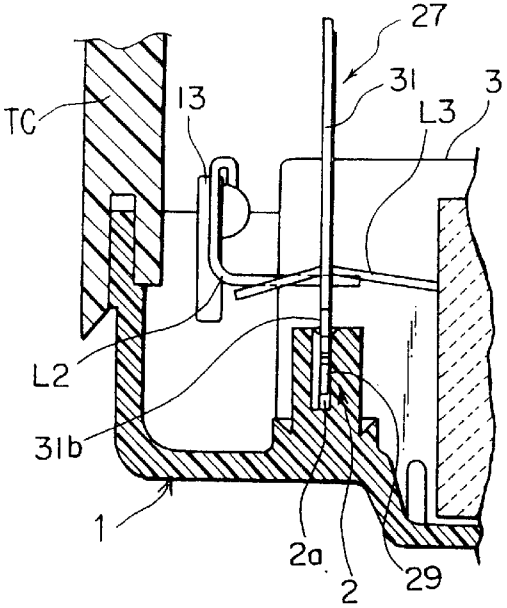

As shown in FIGS. 1B and 1C, the lead wire connection terminal fitments 17, 19 and 21 connected to the input electrode E1, output electrode E2 and output electrode E3 arranged on the rear surface of the variable resistance circuit board 11 are connected to the first lead wire L1 of the fixed resistance circuit board 13, a first lead wire L5 of a capacitor C1, a first lead wire L6 of a capacitor C2, respectively. The capacitor C1 acts as a capacitor for a filter and the capacitor C2 acts as a capacitor for cutting a DC component. The terminal fitments 17, 19 and 21 are constructed in substantially the same manner. Thus, a structure of each of the terminal fitments and connection between the terminal fitment and the lead wire will be described in connection with the terminal fitment 17 with reference to FIGS. 3A to 3C. FIGS. 3A and 3B shows the terminal fitment embedded in the insulating resin layer 12 and FIG. 3C shows the terminal fitment 17 prior to embedding thereof in the insulating resin layer. In order that the illustrated embodiment may be readily understood, the insulating resin layer 12 is shown to be transparent in FIGS. 3A and 3B. The terminal fitment 17 includes a soldering connection section 17*a* projected from the front surface of the circuit board 11 via the through-hole H3 of the circuit board 11, an extension section 17*b* arranged so as to be contiguous to the connection section 17*a* and extend along the rear surface of the circuit board 11, a lead wire connection section 17*c* arranged so as to be contiguous to the extension section 17*b* and extend in a direction away from the rear surface of the circuit board 11, and a pair of reinforcing sections 17*d* and 17*e*. The connection section 17*a* is connected to the input electrode E1 formed on the front surface of the circuit board 11 by soldering.

The lead wire connection section 17*c* is formed into a plate-like shape. The lead wire connection section 17*c* is formed with a groove, which extends from an upper end surface of the lead wire connection section 17*c* toward the circuit board 11 to provide a lead wire inlet 17*f* and a lead wire press fit groove 17*g* in which the lead wires are pressedly fitted. The lead wire inlet 17*f* is formed into an inverted trapezoid shape, resulting in being gradually reduced in width from an end surface of the lead wire connection section 17*c* to a central portion thereof. The lead wire press fit groove 17*g* is formed into a shape like an elongated hole and arranged so as to communicate at one end thereof with the lead wire inlet 17*f* and terminate at the other end thereof at a base of the lead wire connection section 17*c*. The lead wire press fit groove 17*g* is formed on an edge thereof with saw-like indentations engaged with the lead wire L1. The lead wire press fit groove 17*g* has the narrowest portion formed into a width smaller than a diameter of the lead wire L1 and the widest portion formed into a width substantially equal to the diameter of the lead wire L1.

Press fitting of the lead wire L1 in the lead wire press fit groove 17*g* is carried out by inserting the lead wire L1 through the lead wire inlet 17*f* into the lead wire press fit groove 17*g*. The lead wire inlet 17*f* is formed into a width larger than a maximum width of the lead wire press fit groove 17*g*, to thereby facilitate introduction of the lead wire into the lead wire press fit groove 17*g*. Press fitting of the lead wire L1 in the lead wire press fit groove 17*g* while holding an end of the lead wire L1 by hand would cause force tending to incline the lead wire connection section 17*c* to be applied to the lead wire connection section 17*c*. However, in the illustrated embodiment, the reinforcing sections 17*d* and 17*e* are arranged so as to extend in a direction away from the extension section 17*b*, resulting in preventing substantial inclination of the lead wire connection section 17*c*.

In the illustrated embodiment, the lead wire inlet 17*f* is arranged on a side of the upper end of the lead wire connection section 17*c* so as to permit the lead wire to be downwardly fitted in the lead wire press fit groove 17*g*. Alternatively, the lead wire inlet 17*f* may be arranged on a side of a lateral end of the lead wire connection section 17*c*, so that the lead wire may be laterally fitted in the terminal fitment 17 or lead wire press fit groove 17*g*. In this instance, the lead wire press fit groove 17*g* may be formed so as to extend in a lateral direction or in a direction parallel to the circuit board 11.

Also, in the illustrated embodiment, the lead wire inlet 17*f* is arranged so as to be open on one side of the lead wire connection section 17*c*. Alternatively, the lead wire inlet 17*f* may be formed into a hole-like shape which is not open on any side of the lead wire connection section 17*c*. In this instance, the lead wire L1 is inserted into the lead wire inlet 17*f* in a manner like that of threading a needle and is extended through the inlet 17*c*. Then, the lead wire L1 is press-fitted in the lead wire press fit groove 17*g*. Further, in the illustrated embodiment, the lead wire inlet 17*f* is arranged. However, arrangement of the lead wire inlet 17*f* is not necessarily required. When the lead wire inlet 17*f* is not arranged, the lead wire press fit groove 17*g* may be formed on any end of the lead wire connection section 17*c*. In this instance, lead wire press fit groove 17*g* is formed into a hole which is open in any one of a thickness direction of the lead wire connection section 17*c*, a width direction thereof or a direction parallel to the circuit board 11, and a height direction thereof or a direction perpendicular to the circuit board 11.

The fixed resistance circuit board 13 is supported by means of three board support pole-like members 8*a*, 8*b* and 8*c* integrally provided on a bottom wall of the fixed resistance circuit board receiving chamber 7 of the casing 1. Supporting of the fixed resistance circuit board 13 may be carried out in such a way as disclosed in Japanese Patent Application Laid-Open Publication No. 161556/1995.

A boundary region between the fixed resistance circuit board receiving chamber 7 and the capacitor receiving chamber 9 is connected to the second fixed resistance circuit board lead wire L2 of the fixed resistance circuit board 13 and the first capacitor lead wire L3 of the capacitor 15 and provided with a relay terminal fitment or lead wire connection terminal fitment 27 which is connected to an output terminal of the fly-back transformer combined with the high-voltage variable resistor unit of the illustrated embodiment, as shown in FIG. 1B. The relay terminal fitment 27 is formed by subjecting a metal plate to pressing or machining.

Now, the relay terminal fitment 27 will be described more detailedly with reference to FIGS. 4A to 5C. The relay terminal fitment 27 includes a fit section 29, a body section 31 and a connection terminal section 33 which are integrally formed together. The fit section 29 is formed into a shape which permits the fit section 29 to be fitted in a fit groove 2*a* formed at a terminal fit projection 2 provided in the insulating casing 1. The relay terminal fitment 27 is formed with a reinforcing section 28 so as to continuously extend from the fit section 29 through the body section 31 to the connection terminal section 33. The reinforcing section 28 has portions 28*a* positioned on the fit section 29 so as to project by a distance or height which permits the fit section 29 to be tightly fitted in the fit groove 2*a*. The fit section 29 is integrally provided on both lateral sides 29*a* thereof with a pair of biting elements 29*b*. The biting elements 29*b* are outwardly projected from the fit section 29 so as to be spaced from each other and each are formed into an inverted triangular shape while being tapered toward a distal end of the fit section 29. Such arrangement of the biting elements 29*b* permits the biting elements 29*b* to deform a wall of the projection 2 defining the fit groove 2*a* when the fit section 29 is fitted in the fit groove 2*a* and bite into the wall of the fit groove when drawing force is applied to the relay terminal fitment 27. This prevents the relay terminal fitment 27 from being detached from the fit groove 2*a* of the projection 2.

Figure 6:
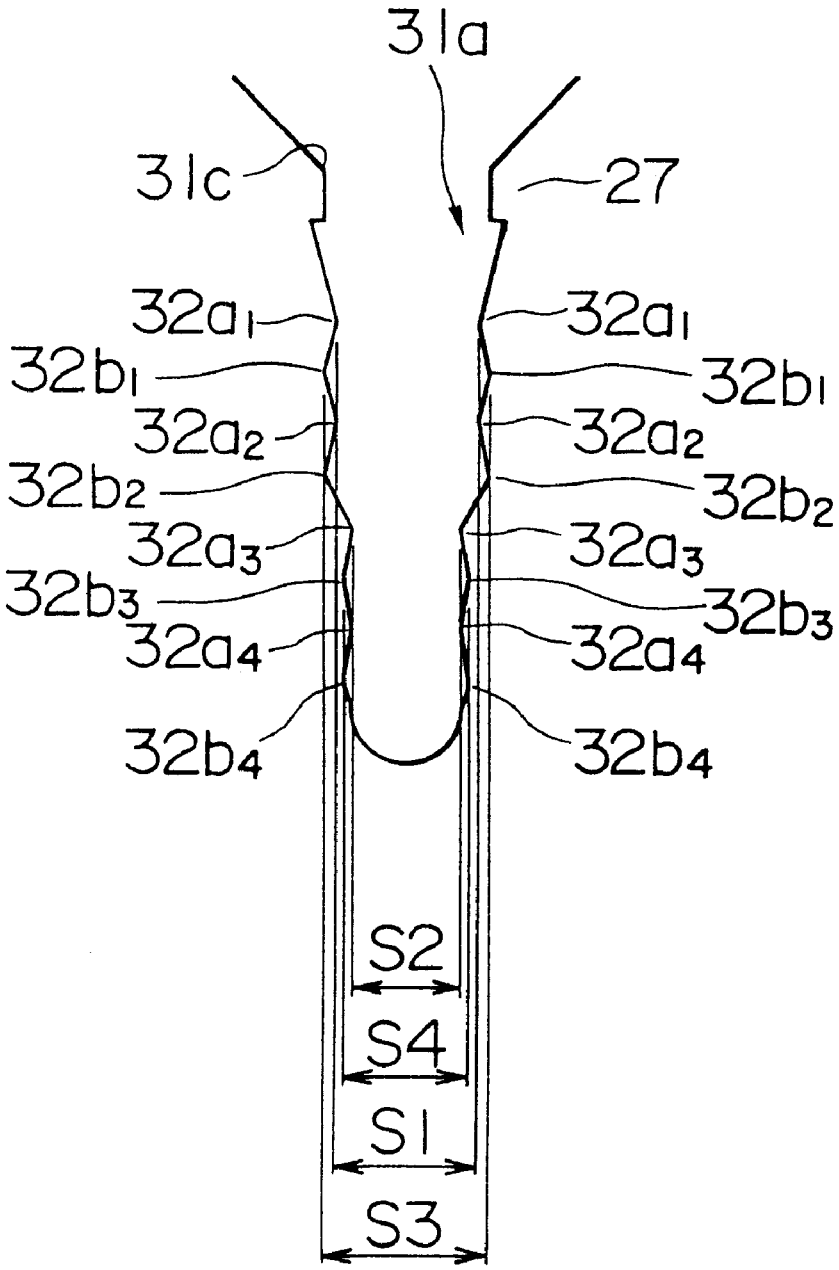
FIG. 6 is an enlarged view showing a plurality of indentations formed in a lead wire press fit groove.

The body section 31 of the relay terminal fitment 27 includes a lead wire press fit groove 31*a* constituting a lead wire connection section and a pair of stoppers 31*b*. The lead wire press fit groove 31*a* includes a lead wire insertion port 31*c* which is open toward the opening of the insulating casing 1. The lead wire press fit groove 31*a* is open on both sides of the relay terminal fitment 27 defined in a thickness direction thereof and is arranged so as to extend from the lead wire insertion port 31*c* toward a wall of the body section 31 opposite to the opening of the insulating casing 1 (or toward the terminal fit projection 2). The lead wire press fit groove 31*a* is press-fitted therein with the second fixed resistance circuit board lead wire L2 of the fixed resistance circuit board 13 and the first capacitor lead wire L3 of the capacitor 15 in order in such a manner that the lead wires L2 and L3 are vertically shifted from each other. The body section 31 is formed with a guide groove 31*d*, which is connected to the lead wire insertion port 31*c* of the lead wire press fit groove 31*a* and gradually decreased in width toward the lead wire insertion port 31*c*. Thus, press fitting of the lead wires L2 and L3 in the lead wire press fit groove 31*a* is carried out by drawing the lead wires L2 and L3 into the lead wire guide groove 31*d* along any one of a pair of plate-like walls $\mathbf{31}d_1$ and $\mathbf{31}d_2$ defining the guide groove 31*d* therebetween. The guide groove 31*d* is formed at an inlet thereof into a width larger than a maximum width of the lead wire press fit groove 31*a*, to thereby facilitate introduction of the lead wires L2 and L3 into the lead wire press fit groove 31*a*. A wall of the body section 31 defining the lead wire press fit groove 31*a* is formed on both surfaces thereof opposite to each other with a plurality of indentations which are adapted to bite into an outer periphery of each of the lead wires L2 and L3, as best seen in FIG. 6. The indentations of the lead wire press fit groove 31*a* include projections $\mathbf{32}a_1$ to $\mathbf{32}a_4$ opposite to each other and recesses $\mathbf{32}b_1$ to $\mathbf{32}b_4$ opposite to each other. The projections $\mathbf{32}a_1$ to $\mathbf{32}a_4$ and recesses $\mathbf{32}b_1$ to $\mathbf{32}b_4$ are arranged so as to alternate with each other. The projections are arranged so as to form a plurality of pairs in such a manner that each pair of projections are opposite to each other. Also, the projections $\mathbf{32}a_1$ to $\mathbf{32}a_4$ may be arranged so that a space defined between the projections opposite to each other is stepwise reduced in width as a distance of the lead wire press fit groove from the lead wire insertion hole is increased. In the illustrated embodiment, the projections $\mathbf{32}a_1$ to $\mathbf{32}a_4$ may be so formed that the space is reduced in width at a position thereof spaced by a distance from the lead wire insertion port 31*c* in a depth direction of the lead wire press fit groove 31*a*, resulting in being divided into a first space portion increased in width and a second space portion decreased in width. Also, this results in the projections $\mathbf{32}a_1$ to $\mathbf{32}a_4$ being separated into first projections $\mathbf{32}a_1$ and $\mathbf{32}a_2$ defining the first space portion and second projections $\mathbf{32}a_3$ and $\mathbf{32}a_4$ defining the second space portion.

Also, the projections $\mathbf{32}a_1$ to $\mathbf{32}a_4$ are so formed that an interval between the projections $\mathbf{32}a_1$ and $\mathbf{32}a_1$ and that between the projections $\mathbf{32}a_2$ and $\mathbf{32}a_2$ which are designated at reference character S1 are larger than an interval between the projections $\mathbf{32}a_3$ and $\mathbf{32}a_3$ and that between the projections $\mathbf{32}a_4$ and $\mathbf{32}a_4$ which are designated at reference character S2. Correspondingly, an interval between the recesses $\mathbf{32}b_1$ and $\mathbf{32}b_1$ and that between the recesses $\mathbf{32}b_2$ and $\mathbf{32}b_2$ which are designated at reference character S3 are formed to be larger than an interval between the recesses $\mathbf{32}b_3$ and $\mathbf{32}b_3$ and that between the recesses $\mathbf{32}b_4$ and $\mathbf{32}b_4$ which are designated at reference character S4. Also, the interval S1 is defined so as to be equal to or larger than a diameter of a core of the second fixed resistance circuit board lead wire L2 and the interval S2 is defined so as to be smaller than the diameter of the core of the lead wire L2. The lead wire L2 is press-fitted in a portion of the press fit groove 31*a* in proximity to a space between the projections 32$a_4$ and 32$a_4$ opposite to each other and the lead wire L3 is press-fitted in a portion of the press fit groove 31*a* in proximity to a space between the projections 32$a_2$ and 32$a_2$ opposite to each other. In the illustrated embodiment, the core of the lead wire L2 has a diameter of 0.50 mm, the interval S1 is set to be 0.54±0.03 mm, the interval S2 is set to be 0.41±0.03 mm, S3 is set to be 0.62±0.03 mm, and the interval S4 is set to be 0.47±0.03 mm. Desirably, the interval between the projections 32$a_1$ to 32$a_4$ is stepwise reduced as a depth of the lead wire press fit groove 31 or a distance thereof from the lead wire insertion port 31*c* is increased. Thus, in the illustrated embodiment, the lead wire press fit groove 31 is so formed that the interval between the projections 32$a_1$ and 32$a_1$ approaches a maximum tolerance of the interval S1, the interval between the projections 32$a_2$ and 32$a_2$ approaches a minimum tolerance of the interval S1, the interval between the projections 32$a_3$ and 32$a_3$ approaches a maximum tolerance of the interval S2, and the interval between the projections 32$a_4$ and 32$a_4$ approaches a minimum tolerance of the interval S2.

In a high-voltage variable resistor unit, mounting of a capacitor in the variable resistor unit is often carried out at a final stage in combination of the variable resistor unit with a fly-back transformer in order to keep quality of the variable resistor unit at an increased level. This causes the first capacitor lead wire L3 of the capacitor 15 to be press-fitted in the lead wire press fit groove 31*a* after press fitting of the second fixed resistance circuit board lead wire L2 of the fixed resistance circuit board 13 therein. The above-described construction of the illustrated embodiment that the second fixed resistance circuit board lead wire L2 is formed into a diameter smaller than that of the first capacitor lead wire L3 permits the first capacitor lead wire L3 to be readily and reliably fitted in the press fit grove 31*a* after press fitting of the second fixed resistance circuit board lead wire L2 therein. Also, the illustrated embodiment, as described above, is so constructed that the fixed resistance circuit board receiving chamber 7 and capacitor receiving chamber 9 are arranged in a manner to be contiguous to each other along the two side walls 3*a* and 3*b* of the variable resistance circuit board receiving chamber 5 adjacent to each other while cooperating with each other to form a substantially L-shape as viewed from the side of the opening of the insulating casing 1. Also, the relay terminal fitment 27 is arranged in the boundary region between the fixed resistance circuit board receiving chamber 7 and the capacitor receiving chamber 9. Such construction ensures smooth press fitting of the lead wires L2 and L3 in the lead wire press fit groove 31*a*.

When it is desired that lead wires of n (n: an integer of 3 or more) in number which are different in diameter are fitted in the lead wire press fit groove 31*a*, the width of the lead wire press fit groove 31*a* may be varied in n stages. Also, when the first capacitor lead wire and second fixed resistance circuit board lead wire have the same diameter, suitable setting of a width of the lead wire press fit groove 31*a* prevents the lead wire firstly fitted in the groove from being broken or cut.

The stoppers 31*b* in a pair are integrally provided on a base of the body section 31 of the relay terminal fitment 27 positioned on a side of the fit section 29 and arranged so as to be spaced from each other in a width direction of the relay terminal fitment 27. The stoppers 31*b* each are abutted against a wall 2*b* of the projection 2 defining the fit groove 2*a* of the projection 2, to thereby prevent the fit section 29 from excessively entering the fit groove 2*a* when the fit section 29 is fitted in the fit groove 2*a*. This permits a length or distance by which the connection terminal section 33 enters the transformer casing TC of the fly-back transformer to be constant, to thereby prevent a failure in connection between the connection terminal section 33 and the fly-back transformer.

The connection terminal section 33 is arranged so as to extend toward the opening of the insulating casing 1 and has a distal end 33*a* pointed so that it may be inserted into an output terminal of the fly-back transformer. Also, the connection terminal section 33 has a base formed so as to be contiguous to one of the plate-like walls 31$d_1$ and 31$d_2$ of the body section 31 defining the guide groove 31*d*. In the illustrated embodiment, the base is connected to the plate-like wall 31$d_2$. Also, the base of the connection terminal section 33 is formed thereon with a slanting surface 33*b* contiguous to the guide groove 31*d*. The slanting surface 33*b* acts as a guide for introducing the lead wire into the lead wire press fit groove 31*a*, as in the guide groove 31*d*. This further facilitates insertion of the lead wire into the lead wire press fit groove 31*a*.

The second capacitor lead wire L4 of the capacitor 15, the second lead wire L7 of the capacitor C2 and a second lead wire L8 of the capacitor C1 are connected to lead wire connection terminal fitments 35, 37 and 39 provided on a terminal fitment mounting section 1*b* of the insulating casing 1, respectively. Also, a ground lead wire L9 connected to the ground electrode E5 is supported on the insulating casing 1 while being fitted in a pin terminal mounting fit section 1*c* provided on the terminal fitment mounting section 1*b*. The terminal fitments 35, 37 and 39 are constructed in substantially the same manner. Thus, a structure of each of the terminal fitments and a connection structure between each terminal fitment and the lead wire will be described hereinafter in connection with the terminal fitment 35 with reference to FIGS. 7A to 8C.

The terminal fitment 35 is mounted in a terminal fitment fit section 41 provided at the terminal fitment mounting section 1*b* of the insulating casing 1. The terminal fitment fit section 41 includes a base section 47 and a pair of raised sections 43 and 45 positioned on the base section 47 in a manner to be raised while being spaced from each other at an interval which permits a curved section 63 of the terminal fitment 35 described hereinafter to be inserted between the raised sections. The raised sections 43 and 45 are formed on inner surfaces thereof with terminal mounting fit grooves 49 and 51 in a pair, respectively. The terminal mounting fit grooves 49 and 51 each are arranged so as to extend from an outside of the insulating casing 1 or an outside of the terminal fitment mounting section 1*b* toward an inside of the insulating casing 1 or the opening of the insulating. The raised sections 43 and 45 are formed with dividing grooves 53 for dividing each of the terminal mounting fit grooves 49 and 51 at an intermediate portion thereof defined in a longitudinal direction thereof, respectively. Also, the terminal mounting fit grooves 49 and 51 are closed at a portion thereof positioned inside the insulating casing 1 with closing sections 55 and 57, respectively,.

Figure 8A:
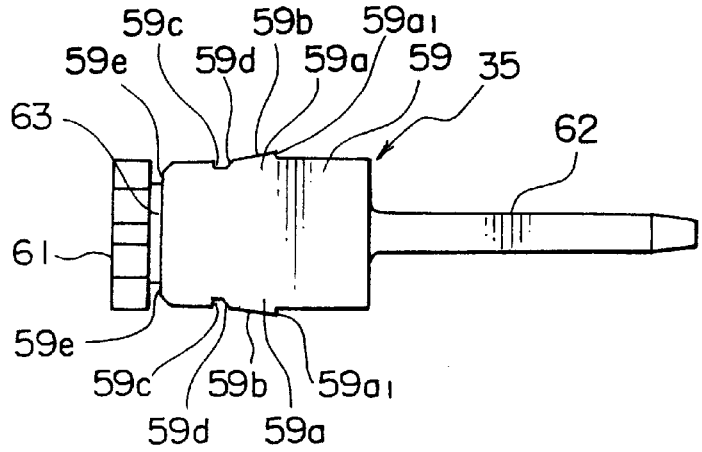
FIG. 8A is a plan view slowing a terminal fitment incorporated in the high-voltage variable resistor unit shown in FIGS. 1A to 1D.
Figure 8B:
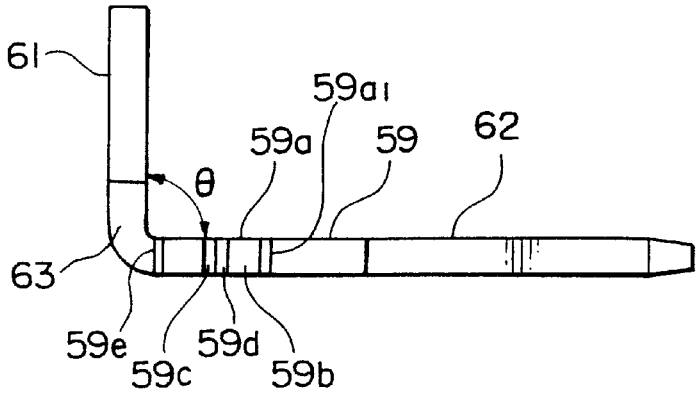
FIG. 8B is a side elevation view of the terminal fitment shown in FIG. 8A.
Figure 8C:
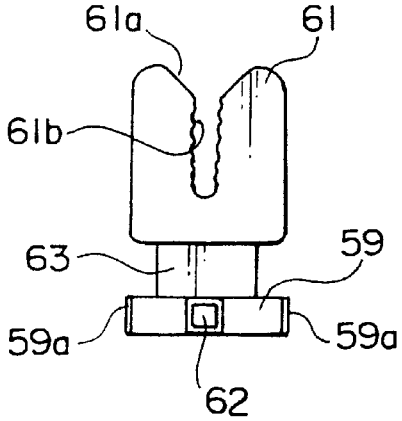
FIG. 8C is a front elevation view of the terminal fitment shown in FIG. 8A.

The terminal fitment 35, as shown in FIGS. 8A to 8C, is formed by subjecting a stainless steel plate of about 0.83 mm in thickness to machining and more particularly pressing and bending. In the illustrated embodiment, the terminal fitment 35 has a surface plated and then subjected to solder plating. The terminal fitment 35 includes a flat elongated fit section 59 of which both ends defined in a width direction thereof are fitted in the terminal mounting fit grooves 49 and 51, a lead wire connection section 61 which is formed integrally with the fit section 59 and to which the lead wire L4 (FIG. 1B) extending from the capacitor 15 is connected, and a terminal section 62 extending to an outside of the insulating casing 1 and electrically connected to the ground electrode. In the illustrated embodiment, the width direction of the terminal fitment 35 is defined as a direction perpendicular to both a thickness direction of the metal plate and a direction in which a terminal section described hereinafter extends. The lead wire connection section 61 and fit section 59 are connected to each other through the curved section 63 while keeping an angle θ therebetween orthogonal or at an angle near a right angle. For example, the angle may be on the order of 90°±5°. The curved section 63, as shown in FIG. 8B, is formed into a substantially L-shape as viewed from a side thereof and has both ends formed into a flat-like shape.

The fit section 59 of the terminal fitment 35 is provided on both ends thereof extending in a longitudinal direction thereof with a pair of projection 59*a*. The projections 59 in a pair are engaged with a part of the terminal fitment fit section 41 to prevent the fit section 59 from being detached from the terminal mounting fit grooves 49 and 51 toward an outside of the insulating casing 1 when both ends of the fit section 59 described above are inserted into the terminal mounting fit grooves 49 and 51 from the outside of the insulating casing 1 to an inside thereof, to thereby be fitted in the grooves 49 and 51. The projections 59*a* are arranged so as to project on both sides of the fit section 59 in the longitudinal direction thereof and each include a slanting surface 59*b* which permits a length by which the projection 59*a* projects in the longitudinal direction to be increased as it extends toward the terminal section 62. In the illustrated embodiment, the fit section 59 is formed on a portion of each of both ends thereof on a side of the terminal section 62 with a flat surface in a manner to be contiguous to the slanting surface 59*b*. Also, the fit section 59 is formed on each of both ends thereof extending in the longitudinal direction thereof with a recess 59*c* in a manner to be contiguous to an end of the slanting surface 59*b* on a side of the lead wire connection section 61. Thus, the recesses 59*c* in a pair each are contiguous to the slanting surface 59*b* on a side of the projections 59*a* and formed with a slanting surface 59*d* having an inclination angle larger than that of the slanting surface 59*b*.

Figure 7A:
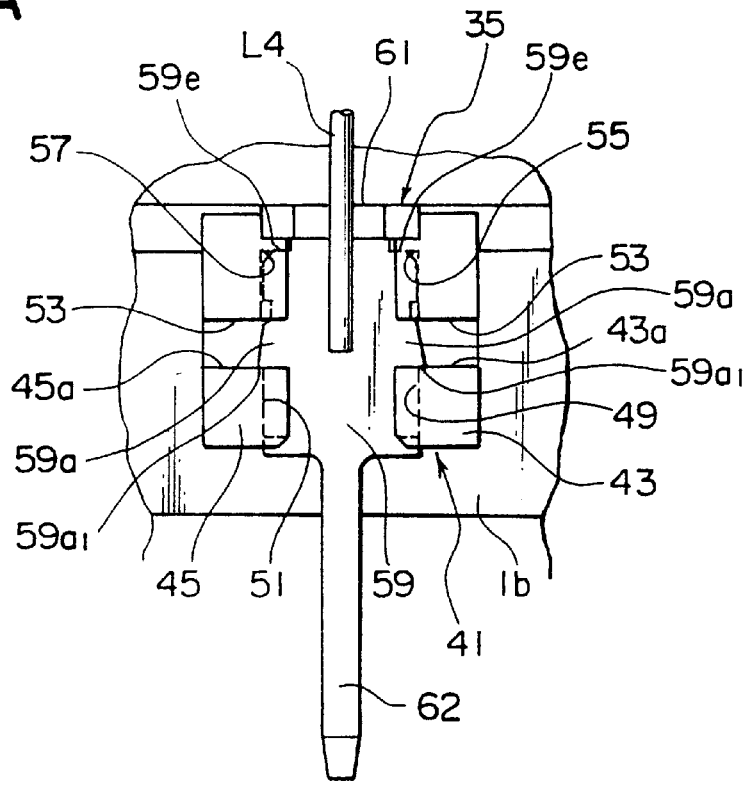
FIG. 7A is an enlarged plan view showing an essential part of a mount section of a terminal fitment incorporated in the high-voltage variable resistor unit shown in FIGS. 1A to 1D.
Figure 7B:
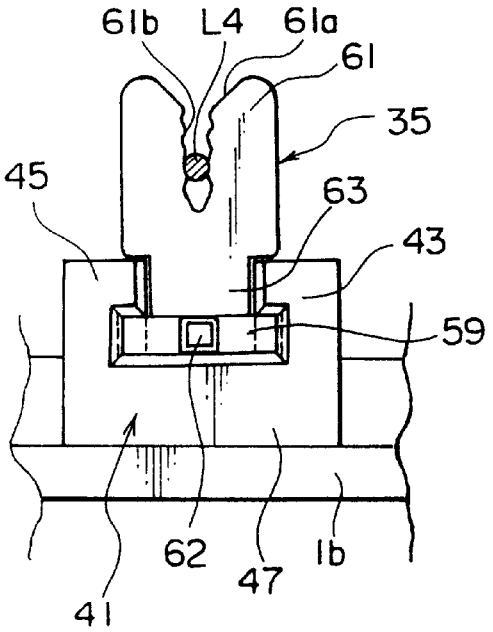
FIG. 7B is a front elevation view of the terminal fitment shown in FIG. 7A.

As shown in FIG. 7A, both ends of the fit sections 59 of the terminal fitment 35 extending in the longitudinal direction are fitted in the terminal mounting fit grooves 49 and 51 and ends 59*e* of the fit section 59 defined on a side of the lead wire connection section 51 are engaged with or abutted against the above-described closing sections 55 and 57 for closing the ends of the terminal mounting fit grooves 49 and 51, so that positioning of the fit section 59 of the terminal fitment 35 may be ensured. Thus, the ends 59*e* each act as a stopper. In this instance, the projections 59*a* provided on the fit section 59 of the terminal fitment 35 are fitted in the dividing grooves 53. At this time, when force in a direction from the inside of the insulating casing to the outside thereof or in a direction from a side of the lead wire connection section 61 to a side of the terminal section 62 is applied to the terminal fitment 3, end surfaces $59a_1$ the projections 59 positioned on a side of the terminal 62 each are abutted against or engaged with inner surfaces 43*a* and 45*a* of the raised sections 43 and 45 defining the dividing grooves 53. This prevents removal of the terminal fitment 35 from the insulating casing 1 when force in a direction from the inside of the insulating casing to the outside thereof or in a direction from the side of the lead wire connection section 61 to the side of the terminal section 62 is applied to the terminal fitment 3.

A width of the terminal section 62 of the terminal fitment 35 defined in a direction perpendicular to a longitudinal direction of the terminal section 62 and a thickness direction of the metal plate is preferably equal to or larger than a thickness of the metal plate. In the illustrated embodiment, the width of the terminal section of the terminal fitment 35 is set to be substantially the same as the thickness of the metal plate. More specifically, it is set to be about 0.83 mm. The fit section 59 and terminal section 62 of the terminal fitment 35 are not subject to bending for reinforcement at all. Even when the fit section 59 and terminal section 62 are not subject to such bending, the terminal section 62 exhibits mechanical strength substantially equal to that of a terminal section of a so-called pin terminal formed by bending a linear conductor of about 1 mm in diameter. Thus, the terminal section 62 of the terminal fitment 35 can be handled in substantially the same manner as the pin terminal. Also, the terminal section 62 is so formed that four corners thereof are curved so as to be outwardly projected and is tapered at a distal end thereof. Such construction of the terminal section 62 further ensures that handing of the terminal section 62 can be carried out like the pin terminal.

The lead wire connection section 61 includes a lead wire insertion opening 61*a* through which a core of the lead wire L4 is insertable into the lead wire connection section 61 and a lead wire press fit groove 61*b* which is formed so as to be contiguous to the lead wire insertion opening 61*a* and in which the core of the lead wire L4 is press-fitted through the lead wire insertion opening 61*a*. The leaf wire insertion opening 61*a* is formed so as to be outwardly enlarged in a trumpet-like shape in section. Such configuration of the opening 61*a* facilitates insertion of the lead wire L4 into the lead wire insertion opening 61*a*. Also, opposite inner surfaces of the lead wire connection section 61 defining the lead wire press fit groove 61*b* therebetween each are formed thereon with a plurality of projections adapted to bite into the core of the lead wire L4. The projections may be formed like saw teeth or in the form of indentations. This results in a width of the lead wire press fit groove 61*b* being smaller than a diameter of the core of the lead wire L4.

In the illustrated embodiment, one lead wire is press-fitted in the lead wire press fit groove 61*b* of each of the terminal fitments 35. Alternatively, a plurality of lead wires may be fitted in each lead wire press-fit groove 61*b*.

Also, in the illustrated embodiment, only the lead wire press fit groove 31*a* of the relay terminal fitment or lead wire connection terminal fitment 27 is so formed that the space defined in the groove or between the projections opposite to each other is stepwise reduced in width as a distance of the lead wire press fit groove from the lead wire insertion hole is increased. However, it is a matter of course that the lead wire press fit groove of each of the other lead wire connection terminal fitments including the terminal fitments 17, 19 and 21 provided on the variable resistance circuit board 11, the terminal fitments 35, 37 and 39 provided on the terminal fitment mounting section 1*b* of the insulating casing 1 and the like may be formed in substantially the same manner as the lead wire press fit groove 31*a*.

Further, in the illustrated embodiment, all the terminal fitments 17, 19, 21, 27, 35, 37 and 39 which are arranged on the side of the opening of the casing 1 and to which the lead wires are connected each are formed with the lead wire press fit groove, so that connection of all the lead wires to the terminal fitments may be carried out by only press fitting. However, a part of the terminal fitments may be free of such a lead wire press fit.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor unit comprising:

a casing made of an insulating resin material;

said casing being formed on one side thereof with an opening and having a variable resistance circuit board receiving chamber, a fixed resistance circuit board receiving chamber and a capacitor receiving chamber defined therein;

a variable resistance circuit board received in said variable resistance circuit board receiving chamber while keeping a rear surface thereof facing said opening and provided on a front surface thereof with a variable resistance circuit pattern including an input electrode, a ground electrode and at least one output electrode;

an input terminal fitment arranged on a rear surface of said variable resistance circuit board and electrically connected to said input electrode;

a fixed resistance circuit board received in said fixed resistance circuit board receiving chamber and formed on a front surface thereof with a fixed resistance circuit pattern including first and second connection electrodes to which first and second fixed resistance circuit board lead wires are respectively connected;

a relay terminal fitment arranged in any one of said fixed resistance circuit board receiving chamber and capacitor receiving chamber or in a boundary region between said fixed resistance circuit board receiving chamber and said capacitor receiving chamber and including a connection terminal section extending toward said opening of said casing and a lead wire connection section to which said lead wires are connected;

a capacitor including first and second capacitor lead wires and received in said capacitor receiving chamber;

said first fixed resistance circuit board lead wire and second fixed resistance circuit board lead wire of said fixed resistance circuit board being connected to said input terminal fitment and said lead wire connection section of said relay terminal fitment, respectively;

said first capacitor lead wire and second capacitor lead wire of said capacitor being connected to said lead wire connection section of said relay terminal fitment and a terminal fitment fixed in said casing;

said relay terminal fitment being made by subjecting a metal plate to machining;

said lead wire connection section being formed with a lead wire press fit groove in which said second fixed resistance circuit board lead wire and first capacitor lead wire are press-fitted;

said lead wire press fit groove including a lead wire insertion port open toward said opening of said casing and being arranged so as be open on both sides of said metal plate in a thickness direction thereof and extend in a direction from said lead wire insertion port toward a wall of said metal plate opposite to said opening;

said metal plate having a pair of inner surfaces defining said lead wire press fit groove therebetween;

said inner surfaces of said metal plate being formed thereon with a plurality of projections and recesses engaged with an outer periphery of said lead wires;

said projections being arranged so as to form a plurality of pairs in such a manner that each pair of projections are opposite to each other;

said projections being arranged so that a space defined between said projections opposite to each other is stepwise reduced in width as a distance of said lead wire press fit groove from said lead wire insertion hole is increased.

2. A high-voltage variable resistor unit as defined in claim 1, wherein said projections are so formed that said space is reduced in width at a position thereof spaced by a distance from said lead wire insertion port in a depth direction of said lead wire press fit groove, resulting in being divided into a first space portion increased in width and a second space portion decreased in width, whereby said projections are divided into first projections defining said first space portion and second projections defining said second space portion.

3. A high-voltage variable resistor unit as defined in claim 2, wherein said first projections defining said first space portion are projected by a distance which permits an interval between said first projections opposite to each other to be larger than a diameter of a core of said fixed resistance circuit board lead wire; and said second projections defining said second space portion are projected by a distance which permits an interval between said second projections opposite to each other to be smaller than said diameter of said core of said fixed resistance circuit board lead wire.

4. A high-voltage variable resistor unit as defined in claim 1, wherein said relay terminal fitment includes a body section formed with said lead wire press fit groove and a fit section integrally provided on one end of said body section and fitted in a fit groove formed at said casing;

said fit groove being formed with an opening which is open toward said opening of said casing;

said fit section of said relay terminal fitment being integrally provided thereon with at least one biting element;

said biting element deforming a wall which defines said fit groove when said fit section is fitted in said fit groove and biting into said wall of said fit groove when drawing force is applied to said relay terminal fitment.

5. A high-voltage variable resistor unit as defined in claim 4, wherein said body section of said relay terminal fitment is integrally provided with at least one stopper which are abutted against a portion of said wall of said fit groove which defines said opening of said fit groove when said fit section is fitted in said fit groove.

6. A high-voltage variable resistor unit as defined in claim 1, wherein said fixed resistance circuit board receiving chamber and capacitor receiving chamber are arranged in a manner to be contiguous to each other along two side walls of said variable resistance circuit board receiving chamber adjacent to each other while cooperating with each other to form a substantially L-shape as viewed from a side of said opening of said insulating casing; and said relay terminal fitment are arranged in a boundary region between said fixed resistance circuit board receiving chamber and said capacitor receiving chamber so that said second fixed resistance circuit board lead wire and capacitor lead wire may be press-fitted in said lead wire press fit groove from both sides of said thickness direction of said metal plate.

7. A high-voltage variable resistor unit as defined in claim 1, wherein said body section of said relay terminal fitment body section is formed with a guide groove;

said guide groove being defined by a pair of plate-like walls and connected to said lead wire insertion port of said lead wire press fit groove and gradually decreased in width toward said lead wire insertion port;

one of said plate-like walls being contiguous to a base of said connection terminal section;

said base of said connection terminal section being formed thereon with a slanting surface contiguous to said guide groove.

8. A high-voltage variable resistor unit as defined in claim 1, wherein all terminal fitments including said relay terminal fitment each include a lead wire connection section;

said lead wire connection section being formed with a lead wire press fit groove.

9. A high-voltage variable resistor unit comprising:

a casing made of an insulating resin material;

said casing being formed on one side thereof with an opening and having a variable resistance circuit board receiving chamber, a fixed resistance circuit board receiving chamber and a capacitor receiving chamber defined therein;

a variable resistance circuit board received in said variable resistance circuit board receiving chamber while keeping a rear surface thereof facing said opening and provided on a front surface thereof with a variable resistance circuit pattern including an input electrode, a ground electrode and at least one output electrode;

an input terminal fitment arranged on a rear surface of said circuit board and electrically connected to said input electrode;

a fixed resistance circuit board received in said fixed resistance circuit board receiving chamber of said casing and formed on a front surface thereof with a fixed resistance circuit pattern including first and second connection electrodes to which first and second fixed resistance circuit board lead wires are respectively connected;

a relay terminal fitment arranged in any one of said fixed resistance circuit board receiving chamber and capacitor receiving chamber or in a boundary region between said fixed resistance circuit board receiving chamber and said capacitor receiving chamber and including a connection terminal section extending toward said opening of said casing and a lead wire connection section to which said lead wires are connected;

a capacitor including first and second capacitor lead wires and received in said capacitor receiving chamber;

said first fixed resistance circuit board lead wire and second fixed resistance circuit board lead wire of said fixed resistance circuit board being connected to said input terminal fitment and said lead wire connection section of said relay terminal fitment, respectively;

said first capacitor lead wire and second capacitor lead wire of said capacitor being connected to said lead wire connection section of said relay terminal fitment and a terminal fitment fixed in said casing;

said relay terminal fitment being made by subjecting a metal plate to machining;

said lead wire connection section being formed with a lead wire press fit groove in which said second fixed resistance circuit board lead wire and first capacitor lead wire are press-fitted.

10. A high-voltage variable resistor unit as defined in claim 9, wherein said lead wire press fit groove includes a lead wire insertion port open toward said opening of said casing and is arranged so as be open on both sides of said metal plate in a thickness direction thereof and extend in a direction from said lead wire insertion port toward a wall of said metal plate opposite to said opening.

11. A high-voltage variable resistor unit as defined in claim 10, wherein said metal plate has a pair of inner surfaces defining said lead wire press fit groove therebetween;

said inner surfaces of said metal plate being formed thereon with a plurality of projections and recesses engaged with an outer periphery of said lead wires.

12. A high-voltage variable resistor unit as defined in claim 11, wherein said projections are arranged so as to form a plurality of pairs in such a manner that each pair of projections are opposite to each other; and said projections are arranged so that a space defined between said projections opposite to each other is stepwise reduced in width as a distance of said lead wire press fit groove from said lead wire insertion hole is increased.

* * * * *